United States Patent [19]

Horng

[11] Patent Number: 4,937,546

[45] Date of Patent: Jun. 26, 1990

[54] RING-CORE TRANSFORMER

[75] Inventor: Jong-Chyr Horng, Kaohsiung, Taiwan

[73] Assignee: Salom Electric Co., Ltd., Kaohsiung, Taiwan

[21] Appl. No.: 329,538

[22] Filed: Mar. 28, 1989

[51] Int. Cl.[5] ..... H01F 15/02

[52] U.S. Cl. ..... 336/65; 336/192

[58] Field of Search ..... 336/65, 192, 198, 208, 336/196, 184

[56] References Cited

U.S. PATENT DOCUMENTS

| | | | |
|---|---|---|---|
| 3,544,937 | 12/1970 | Boysen | 336/192 X |
| 4,603,314 | 7/1986 | Fukunaga et al. | 336/65 |
| 4,709,205 | 11/1987 | Baurand et al. | 336/65 |
| 4,748,405 | 5/1988 | Brodzik et al. | 336/65 X |

FOREIGN PATENT DOCUMENTS

| | | | |
|---|---|---|---|
| 131700 | 1/1985 | European Pat. Off. | 336/65 |
| 2556879 | 6/1985 | France | 336/65 |
| 55-138809 | 10/1980 | Japan | 336/65 |
| 60-157209 | 7/1985 | Japan | 336/65 |
| 60-208808 | 10/1985 | Japan | 336/65 |
| 871707 | 6/1961 | United Kingdom | 336/65 |

*Primary Examiner*—Thomas J. Kozma

*Attorney, Agent, or Firm*—Ladas & Parry

[57] ABSTRACT

This invention discloses an improved ring-core transformer which includes a ring core, a pair of coil former, a frame body, a pair of protrusions, at least one row of pin bases, a plurality of connecting pins and coils, wherein the coils are respectively wound on the pair of coil former. Each coil has a plurality of output terminals leading therefrom and is connected to the pins by being passed through the gaps between the pin bases and fixed in the slots formed on the pin bases. Therefore, the ring core transformer of this invention can offer excellent insulation by the isolation of the terminals also provide a wide range of output voltage.

4 Claims, 3 Drawing Sheets

RING-CORE TRANSFORMER

BACKGROUND OF THE INVENTION

This invention relates to an improved transformer, and particularly to a ring core transformer which has a plurality of sets of output power supply terminals with different output voltages and an improved insulated frame to mount the main body.

Generally, a transformer is an electrical apparatus which couples an alternating-current (ac) electric voltage/current at its primary source to a plurality of secondary voltage/current through a magnetic flux coupling. The principle of a transformer is to utilize the function of electromagnetic induction, which is excited the primary winding and induces the secondary windings for various voltages. The core of a transformer which provides an enclosed flux loop path is substantially made of multiple layer laminated silicon steel sheets so that the eddy currents can be minimized. The conventional magnetic core of a transformer adopts an EI type or EE type core. It has shortages of higher power consumption and therefore it is less efficient.

Recently, a ring-core transformer is developed. Although it brings better efficiency in power transformation, several defects still exist such as limitation of the number of output terminals and destruction of the insulation between terminals. Referring to FIG. 1, a perspective view of a conventional ring-core transformer is shown. Referring to FIG. 2, a secional view of a conventional ring-core transformer is shown. This conventional ring core transformer 1 comprises a ring core 11 which is usually made by silicon steel sheets, two coil formers 12 surrounding the core 11, primary/secondary windings 13 attached to said coil formers 12, several pairs of output terminals 14, insulating spacers 15 usually made of insulating papers which are distributed between the layers of terminals 14, and a metal frame 16. Each output terminal 14 leading out from the windings 13 has a central electric wire core 131 and is protected by an insulating sleeve 132. Usually, all the secondary output terminals 14 are disposed within the inter spaced gaps 17 formed between the coils 13. By means of the insulating spacers 15, sets of output terminals 14 of the windings 13 are superimposed on one another to save the space.

As previously described, although the power loss of the conventional transformer has been reduced, some defects still remain with the ring-core transformer.

(a) The output terminals 14 from the winding must be insulated by means of insulating sleeves 132 or insulation spacers 15. Moreover, the insulation on the outer surface of each wire core 131 must be pared out prior to the connection of the output terminals 14 to an electric appliance or circuit. It is also still necessary to insulate the connection by applying suitable insulating material. Therefore, in a conventional ring-core transformer is complicated and troublesome, the manufacturing cost on workman hour is high and the insulation arrangement is not economical.

(b) The number of the output terminals 14 leading out from the winding 13 are limited because the spaced gap 17 between the coils 13 is relatively restricted. As shown in FIG. 2, the spaced gap 17 allows only about four pairs of output terminals to fit in. It causes the possible output voltage values to be greatly limited, and requires the use of more transformers in a power supply system.

(c) The conventional ring core transformer is unable to be used on a printed-circuit board (PCB).

Therefore, an attempt has been made to use an improved ring-core transformer, according to this invention, to provide relatively more flexible output terminal pairs and better insulation, especially at the output terminal which leads from the windings of the transformer. Thus, a transformer of this invention not only overcomes the defects of the prior art, but also increases the lifetime and reduces the manufacturing cost thereof.

SUMMARY OF THE INVENTION

It is therefore a main object of this invention to provide an improved ring-core transformer having a frame which may improve the insulation between the output terminals and affix outer windings to the pin bases.

Another object of this invention is to provide an improved ring-core transformer having a plurality of sets of output voltages to extend the transformer application for various conditions.

A further object of this invention is to provide an improved ring-core transformer having a plurality of pins on the pin bases thereof so as to allow said transformer to be mounted onto a printed-circuit board (PCB).

Therefore, a transformer with a supporting member according to this invention comprises:

a ring core which has two opposite and relatively straight portions as well as two curved portions respectively connected between the adjacent ends of the two straight portions respectively;

a pair of coil former respectively attached so as to surround the two straight portions, each of said pair of coil former having two end spacers adjacent to said two curved portions of the ring core;

a frame substantially plane-shaped with a pair of opposite sides;

a plurality of protrusions extending from said sides of the frame, said protrusions being adapted to be simultaneously and respectively engaged with said ring core;

at least one row of pin bases separated from one another by a gap and protruding from at least one of said opposite sides of the frame in a direction opposite that of said protrusions, each pin base having a positioning slot formed thereon;

a plurality of connecting pins, each being respectively formed on said each pin base; and coils respectively wound on the pair of coil former, each coil having a plurality of output terminals respectively leading therefrom, and each coil having a predetermined number of turns, said terminals being connected to said posts by being passed through gaps between the frame and fixed in the slots formed thereon.

BRIEF DESCRIPTION OF THE DRAWINGS

Other features and objects of this invention will become apparent, in the following detailed description of the embodiments of the invention by referring to the drawings.

DETAILED DESCRIPTION OF THE PREFERRED EMBODIMENT

Figure 1:
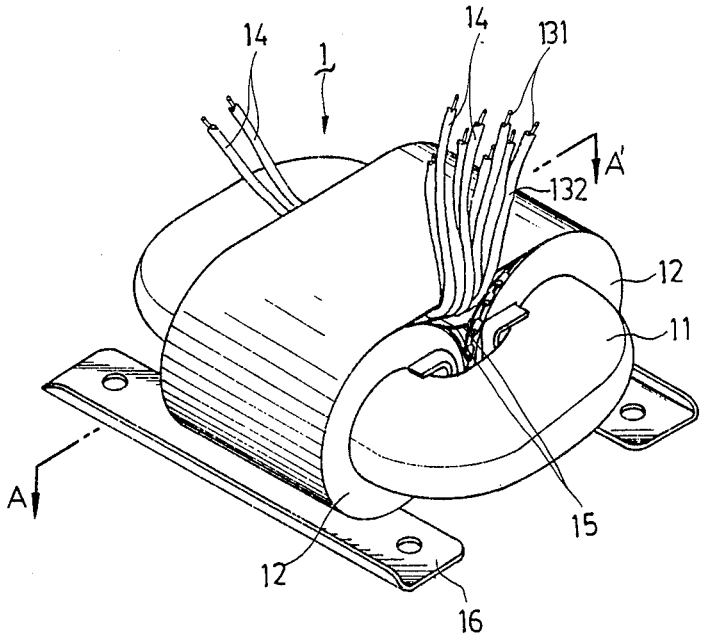
( PRIOR ART ) FIG. 1
FIG. 1 is a perspective view of a conventional ring-core transformer.
Figure 2:
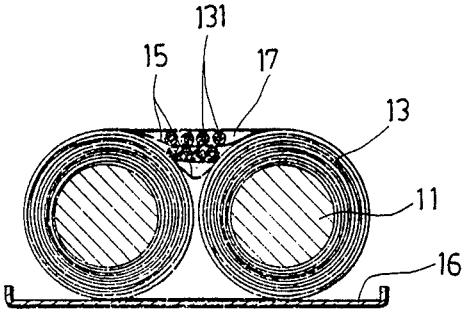
( PRIOR ART ) FIG. 2
FIG. 2 is a cross sectional view along the line A—A' of FIG. 1.
Figure 3:
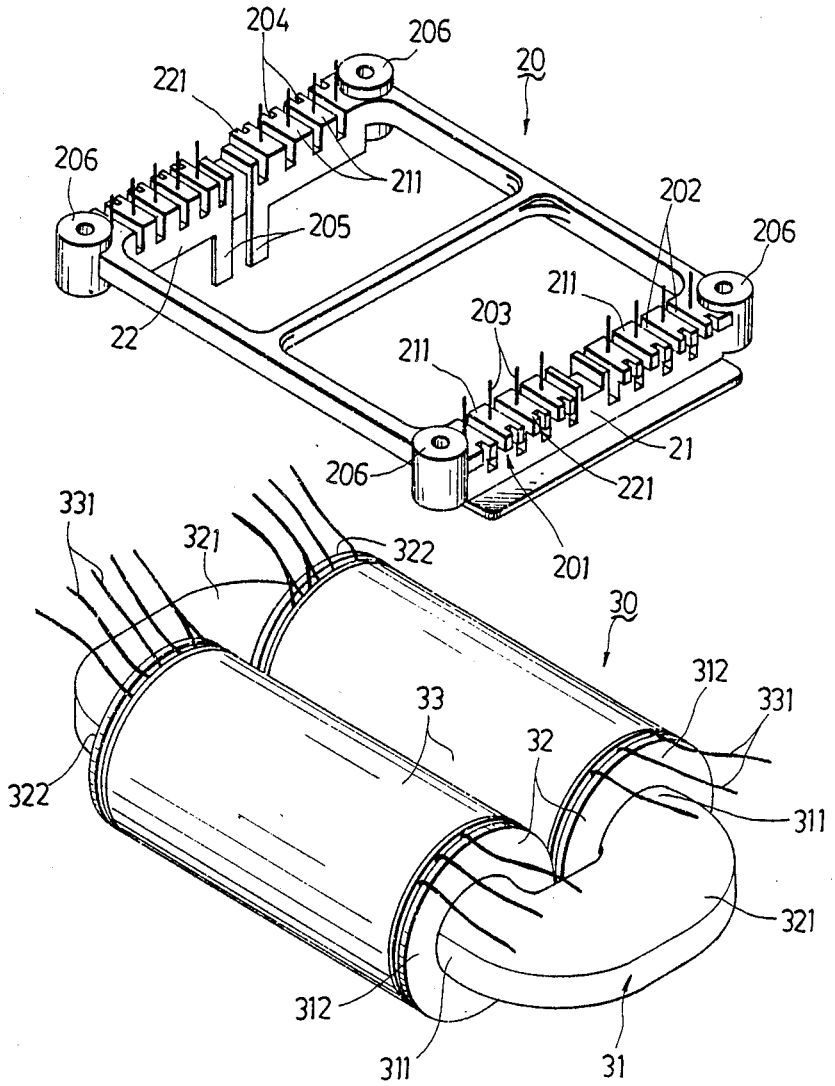
FIG. 3 is an exploded perspective view of an improved ring-core transformer according to this invention.

Referring to FIG. 3, an exploded perspective view of an improved ring core transformer is shown, which comprises a frame 20 and a ring core assembly 30. The frame 20 has two opposite sides 21 and 22 each having a plurality of pin bases 201 formed thereon in a row and protruded therefrom in an upright direction. Each pin base 201 has a top surface 211 with a post 203 formed on the top surface 211 of the pin base 201. Each pin base 201 also has an edge portion 221 with a slot 204 formed thereon. On each side 21, 22 and between every adjacent pin base 201, there are a plurality of spaced gaps 202 formed thereon. The transformer also includes a ring core assembly 30 which further includes a ring core 31 made of a plurality of laminated silicon steel sheets and two coil formers 32 around which the coil windings 33 are wound. The ring core 31 comprises substantially a pair of opposing straight portions 311 and two curved portions 321. Each coil former 32 is sleeved on the straight portions 311 of the ring core 31 and has spacers 312 and 322 formed on the two ends thereof for guiding and restraining the coil windings 33. Of course, insulation sheets may be provided between every two layers of coi windings 33. Electric input and output terminals 331 can be led out from each of the coil windings 33. In order to achieve a better insulative effect, said plurality of guided slots 204 are provided to lay lead wires for input and output terminals 331. The output terminals 331 of the windings 33 are led through said slots 204 and welded onto said pins 203. In order for the frame 20 to be attached to the ring core 31, a pair of protrusions 205 are provided at the center of each of the two sides 21 and 22 of the frame 20. Since the distance between the two opposite sides 21 and 22 of the frame 20 matches the distance between the two curved portions 321 of the ring core 31, said frame 20 and said ring-core assembly 30 can thus be tightly assembled with each other.

At the beginning of assembly, the protrusions 205 are inserted and positioned into the inner surface of the curved portions 321 of the ring core 31 so that a steady and fixed combination of the frame 20 and the ring-core assembly 30 is achieved. The output terminals 331 of the windings 33 are then led through the spaced gaps 202 and guided slots 204 of the pin bases 201, and welded to the pins 203. In this way, an improved ring-core transformer is completed.

Figure 4:
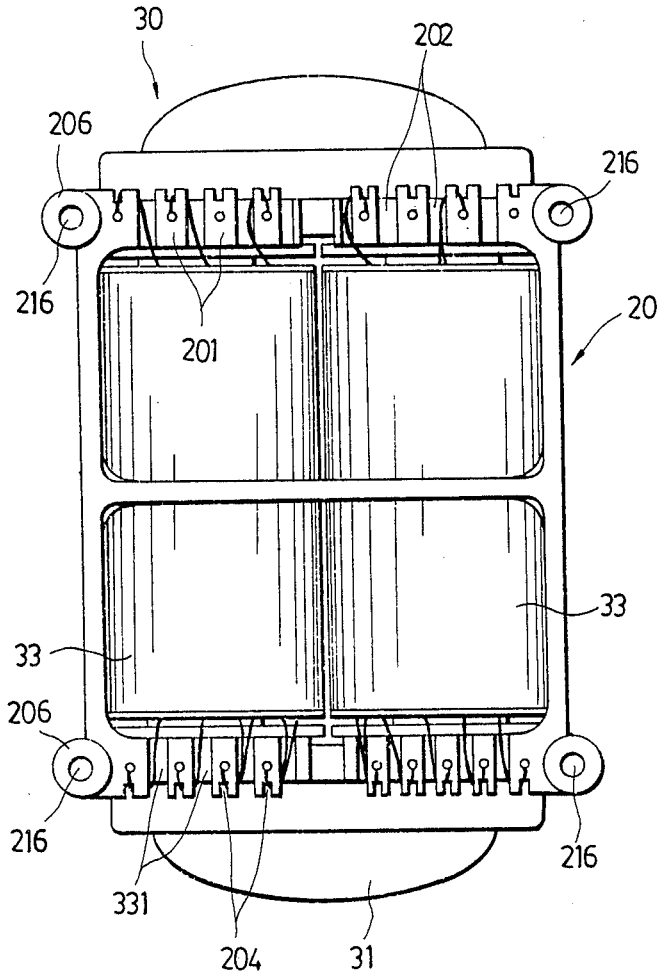
FIG. 4 is a top view of an embodiment of an improved ring-core transformer of FIG. 3.

Referring now to FIG. 4, a top view of an improved ring-core transformer according to the invention is shown. It should be noted that the output terminals 331 of the winding 33 are placed in sequence within the spaced gaps 202 between the pin bases 201 to serve and effect the function of absolute insulation. In order to have an even better insulative effect, in addition to separation of the terminals by spaced gaps, the output terminals 331 of the windings are advanced into the guided slots 204 on the bases 201 and then connected to the posts 203 so as to prevent a short circuit of the output terminals 231 of the windings. For the purpose of connecting the ring-core transformer to an electric circuit, four pillars 206 are provided at the corners of the frame 20. Each pillar 206 has a bore 216 formed therein for the passing through of a screw. In addition, the transformer 30 can be mounted onto a printed-circuit board (PCB) by inserting the pins 203 into the corresponding pin holes on the PCB.

In accordance with the above description, the ring-core transformer of this invention has the following advantages.

(a) The windings on the coil formers 32 can have a pre-determined number of turns so that output terminal 331 with different output voltages values can be led therefrom for supplying power for various electric load.

(b) The spaced gap 202 formed on the pin bases 201 of the frame 20, not only simplifies the connection of the terminals, but also provides a perfect insulation by isolating each of the winding terminals 331.

(c) The output terminals 331 of the windings may be connected to the pins 203 formed on the frame 20, and the pins may be inserted into a printed-circuit board (PCB) or other circuit device. Thus, it is more convenient and useful than the transformer of the prior art.

Although the invention has been described in terms of certain preferred embodiments, modifications will be apparent to those skilled in the art. All such modifications are intended to be included within the scope of the following claims.

I claim:

1. A transformer attached to a supporting member, comprising:

a ring core which has two opposing straight portions and two curved portions respectively connected between the adjacent ends thereof;

a pair of coil formers respectively attached so as to surround around the two opposing straight positions, said pair of coil formers having two end spacers adjacent to said two curved portions of the ring core;

a frame which is substantially plane-shaped with a pair of opposing sides;

a plurality of protrusions extending from said sides of the plane frame, said protrusions being adapted to be simultaneously and respectively engaged with said ring core;

at least one row of pin bases separated from one another by a gap and protruding from at least one of said opposite sides of the plane frame in a direction opposite that of said protrusions, each pin base having a positioning slot formed thereon;

a plurality of connecting pins, each being respectively formed on said pin bases; and coils respectively wound on the pair of coil former, each coil having a plurality of output terminals respectively leading therefrom, and each coil having a pre-determined number of turns, said terminals being connected to said pins by being passed through gaps between the pin bases and fixed in the slots formed thereon.

2. A transformer as claimed in claim 1, wherein the distance between said two opposing sides of said frame is shorter than that between said two curved portions of said ring core.

3. A transformer as claimed in claim 2, wherein said frame further comprises four circular pillars each having a bore formed therein, positioned at the corners of the said frame.

4. A transformer as claimed in claim 1, wherein said output terminals of the windings are spaced apart from one another by said gaps and slots.

* * * * *